US008766814B2

(12) United States Patent
Emoto et al.

(10) Patent No.: US 8,766,814 B2
(45) Date of Patent: Jul. 1, 2014

(54) MOTORMAN'S CAB DISPLAY SYSTEM AND DISPLAY CONTROL METHOD FOR MOTORMAN'S CAB DISPLAY APPARATUS

(75) Inventors: Norishige Emoto, Tokyo (JP); Kengo Kobatake, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/810,580

(22) PCT Filed: Jul. 20, 2010

(86) PCT No.: PCT/JP2010/062172

§ 371 (c)(1),
(2), (4) Date: Jan. 16, 2013

(87) PCT Pub. No.: WO2012/011164

PCT Pub. Date: Jan. 26, 2012

(65) Prior Publication Data

US 2013/0119205 A1 May 16, 2013

(51) Int. Cl.
*G08B 5/00* (2006.01)

(52) U.S. Cl.
USPC ..... 340/815.41; 340/501; 340/540; 340/902; 340/988; 246/62; 246/191; 246/182 R; 348/148; 348/159; 348/477; 348/488

(58) Field of Classification Search
CPC ..... B61L 2003/00; B61L 23/00
USPC ..... 340/815.41, 501, 540, 902, 988; 246/62, 191, 182 R; 348/148, 159, 477, 348/488
See application file for complete search history.

(56) References Cited

U.S. PATENT DOCUMENTS 5,452,870 A * 9/1995 Heggestad ..... 246/182 R
5,785,283 A * 7/1998 Ehrenberger et al. ..... 246/62

FOREIGN PATENT DOCUMENTS

JP 4-325323 A 11/1992
JP 5-38966 A 2/1993

(Continued)

OTHER PUBLICATIONS

International Search Report (PCT/ISA/210) issued on Aug. 24, 2010, by the Japanese Patent Office as the International Searching Authority for International Application No. PCT/JP2010/062172.

(Continued)

*Primary Examiner* — Tai T Nguyen
(74) *Attorney, Agent, or Firm* — Buchanan Ingersoll & Rooney PC

(57) ABSTRACT

A motorman's cab display system includes a motorman's cab display apparatus that can automatically adjust display luminance of a display device without using an illuminance sensor. The motorman's cab display apparatus determines, based on location information of a train transmitted from a train information control system, whether the train is traveling in a tunnel, sets, when determining that the train is traveling in the tunnel, as the luminance of a display screen, luminance for inside of tunnel set in advance, and sets, when determining that the train is traveling outside the tunnel, as luminance of the display screen, luminance information for outside of tunnel set in advance. A display control method for motorman's cab display apparatuses includes: calculating a traveling location of the train; and adjusting the luminance of the display screen according to the luminance information output from a luminance determining unit.

15 Claims, 12 Drawing Sheets

1

(56) References Cited

FOREIGN PATENT DOCUMENTS

| | | | |
|---|---|---|---|
| JP | 5-310077 | A | 11/1993 |
| JP | 6-261406 | A | 9/1994 |
| JP | 11-184446 | A | 7/1999 |
| JP | 11-215489 | A | 8/1999 |
| JP | 2006-182301 | A | 7/2006 |
| JP | 2009/157227 | A | 12/2009 |

OTHER PUBLICATIONS

Written Opinion (PCT/ISA/237) issued on Aug. 24, 2010, by the Japanese Patent Office as the International Searching Authority for International Application No. PCT/JP2010/062172.

* cited by examiner

MOTORMAN'S CAB DISPLAY SYSTEM AND DISPLAY CONTROL METHOD FOR MOTORMAN'S CAB DISPLAY APPARATUS

FIELD

The present invention relates to a motorman's cab display system including a motorman's cab display apparatus set in a motorman's cab in a motorman's car or a conductor's compartment of a train and a display control method for the motorman's cab display apparatus.

BACKGROUND

A motorman's cab display apparatus set in a motorman's cab in a motorman's car or a conductor's compartment of a train functions as a man-machine interface of a train information control system that controls various kinds of information through a communication network in a train formation. The motorman's cab display apparatus displays, for example, operation information of the train and monitoring information of on-board apparatuses and enables a motorman to input control information into a train information control system by operating a touch panel provided on a display surface of the motorman's cab display apparatus.

Patent Literature 1 describes a head-up display that projects display contents of a motorman's cab display apparatus on a front glass and displays the display contents.

CITATION LIST

Patent Literature

Patent Literature 1: Japanese Patent Application Laid-open No. 05-38966

SUMMARY

Technical Problem

For example, an LCD (Liquid Crystal Display), an EL (Electro Luminescence), or the like has been used as a display device of a motorman's cab display apparatus in the past. In general, the display device is required to have high luminance taking into account visibility in a motorman's cab in the daytime. On the other hand, at night or during tunnel traveling, it is necessary to reduce luminance because the display device is too bright at display luminance same as the display luminance in the daytime. Luminance adjustment has been manually performed or automatically performed by attaching an illuminance sensor.

When the luminance adjustment is automatically performed, it is necessary to sense illuminance in a forward direction viewed from the motorman's car (i.e., illuminance outside of a train) with the illuminance sensor. However, because a screen of the motorman's cab display apparatus is set to face a crew member side which is opposite to the forward direction, with a configuration in which the illuminance sensor is provided on the inside of the motorman's cab display apparatus, it is difficult to appropriately sense illuminance in the forward direction. Therefore, it is necessary to separately set the illuminance sensor, connect the illuminance sensor to the motorman's cab display apparatus using a cable or the like, and sense illuminance in the forward direction.

However, it is difficult to separately set the illuminance sensor in the motorman's car in which a setting place is limited. Further, there is a problem in that wiring by a cable is weak in anti-noise properties in a train in which there is a lot of disturbance noise.

The present invention has been made to solve the above described problems and it is an object of the present invention to obtain a motorman's cab display system including a motorman's cab display apparatus that can automatically adjust display luminance of a display device without using an illuminance sensor and a display control method for the motorman's cab display apparatus.

Solution to Problem

To solve the above described problems and achieve the object, a motorman's cab display system includes: information control terminal apparatuses respectively mounted on cars of a train, connected to one another by an inter-car transmission path, and configured to collect state information of apparatuses mounted on the cars and output control information to the apparatuses; information control central apparatuses respectively mounted on a first car and a last car of the train, connected to the information control terminal apparatuses by the inter-car transmission path, and configured to manage train information including the state information received from the information control terminal apparatuses and the control information transmitted to the information control terminal apparatuses; motorman's cab display apparatuses respectively mounted on the first car and the last car, connected to the information control central apparatuses by transmission paths for display apparatus, and configured to display the train information transmitted from the information control central apparatuses on a display screen of a display device; and a luminance determining unit configured to output luminance information for setting luminance of the display screen. The information control central apparatus includes a location-information calculating unit configured to calculate a traveling location of the train and output location information of the train. The motorman's cab display apparatus includes a luminance adjusting unit configured to adjust the luminance of the display screen according to the luminance information output from the luminance determining unit. The luminance determining unit compares location information at both ends of a tunnel section on a track of the train and the location information of the train output from the location-information calculating unit, outputs, when determining that the train is traveling in a tunnel, luminance information for inside of tunnel set in advance, and outputs, when determining that the train is traveling outside the tunnel, luminance information for outside of tunnel set in advance.

A display control method for motorman's cab display apparatuses is a method where the display apparatuses are respectively mounted on a first car and a last car of a train, connected to information control central apparatuses that collect and manage train information and transmission paths for display apparatus, and configured to display the train information transmitted from the information control central apparatuses on a display screen of a display device. The display control method includes: a step of a location-information calculating unit provided in the information control central apparatus calculating a traveling location of the train and outputting location information of the train; a step of a luminance determining unit provided in the motorman's cab display apparatus or the control central apparatus comparing location information at both ends of a tunnel section on a track of the train and the location information of the train output by the location-information calculating unit, outputting, when determining that the train is traveling in a tunnel, luminance information for inside of tunnel set in advance, and outputting, when determining that the train is traveling outside the tunnel, luminance information for outside of tunnel set in advance; and a step of a luminance adjusting unit provided in the motorman's cab display apparatus adjusting the luminance of the display screen according to the luminance information output from the luminance determining unit.

Advantageous Effects of Invention

According to the present invention, there is an effect that it is possible to automatically perform luminance adjustment even if an illuminance sensor is not provided.

DESCRIPTION OF EMBODIMENTS

Embodiments of a motorman's cab display system and a display control method for a motorman's cab display apparatus according to the present invention are explained in detail below based on the drawings. The invention is not limited by the embodiments.

First Embodiment

Figure 1:
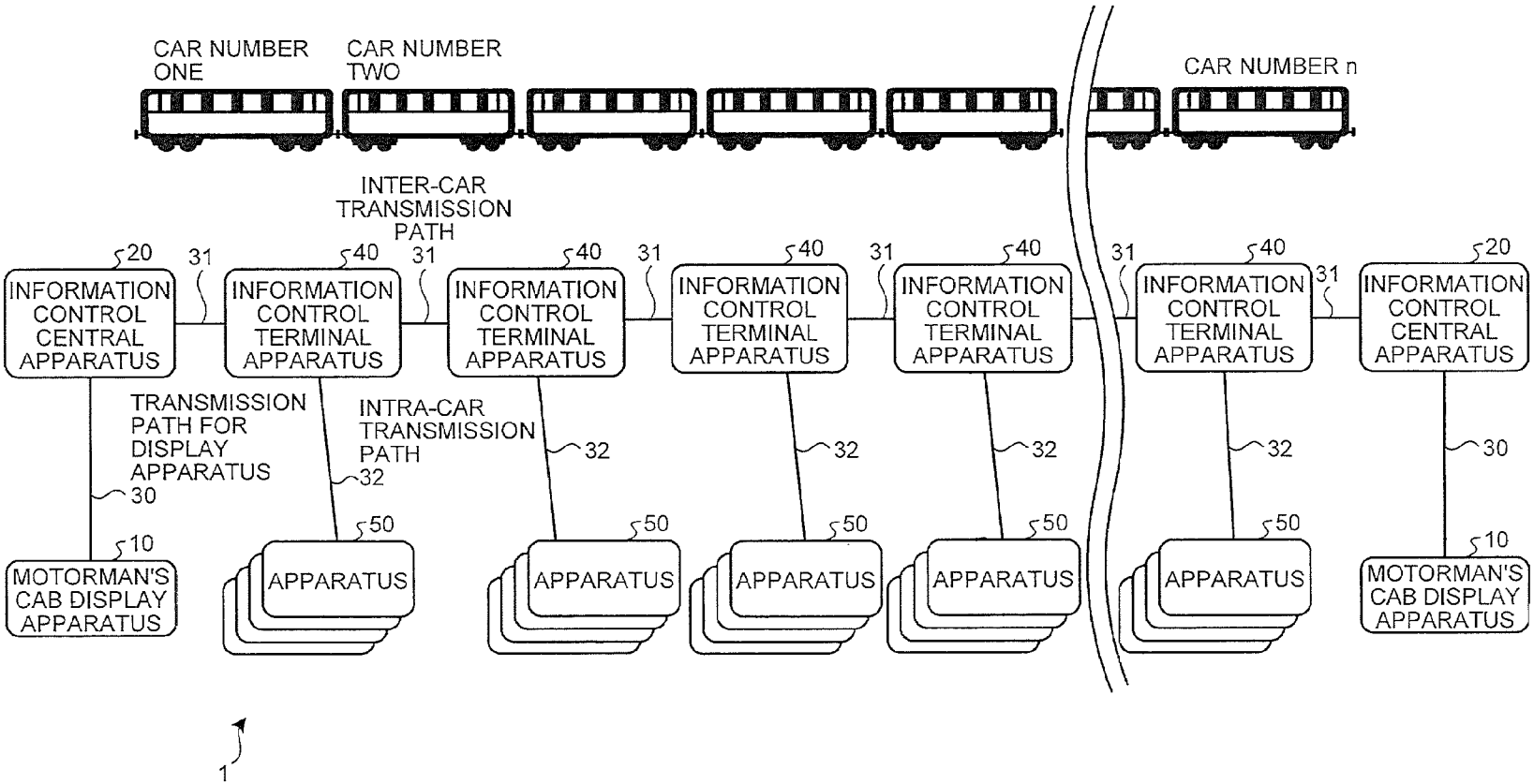
FIG. 1 is a diagram of a configuration example of a train information control system 1 in a first embodiment.

FIG. 1 is a diagram of an example of the configuration of a train information control system 1 in the first embodiment. As shown in FIG. 1, a train consists of n cars from a car number one to a car number n (n is an integer equal to or larger than 1). In each of the car number one, which is the first car, and the car number n, which is the last car, a motorman's cab display apparatus 10, an information control central apparatus 20, an information control terminal apparatus 40, and a plurality of apparatuses 50 are mounted. In each of the other intermediate cars, the information control terminal apparatus 40 and the apparatuses 50 are mounted.

The apparatuses 50 mounted on each of the cars are, for example, a door, an air conditioner, a brake, a motor, an ATO (automatic train operating apparatus), an SIV (stationary inverter functioning as an auxiliary power supply), or an automatic broadcasting apparatus.

The information control central apparatus 20 and the information control terminal apparatus 40 are connected to each other by an inter-car transmission path 31. The inter-car transmission path 31 is a transmission path disposed between the cars and can be configured using, for example, a LAN line. The information control terminal apparatus 40 mounted on each of the cars is connected to the apparatuses 50 by an intra-car transmission path 32. The intra-car transmission path 32 is a transmission path disposed in the car and can be configured using, for example, a LAN line.

The information control central apparatus 20 and the information control terminal apparatus 40 are respectively a central apparatus and a terminal apparatus of an information control apparatus. The information control central apparatus 20 and the information control terminal apparatus 40 collect train information and perform monitoring and control of the apparatuses 50 in cooperation with each other. Specifically, the information control terminal apparatus 40 collects state information and the like concerning the apparatuses 50 via the intra-car transmission path 32. The information control terminal apparatus 40 transmits the collected state information and the like to the information control central apparatus 20 and the information control terminal apparatuses 40 in the other cars via the inter-car transmission path 31. The information control central apparatus 20 is connected to a control operation apparatus (not shown) such as a master controller. The information control central apparatus 20 transmits control information, which is input from the control operation apparatus or the like, to the apparatuses 50 via the information control terminal apparatus 40 of each of the cars and controls the apparatuses 50.

The information control central apparatus 20 and the information control terminal apparatus 40 manage various kinds of train information such as train operation information including stop station information and time for departure from and arrival at station information; train location information indicating kilometrage from a reference point (e.g., a departure station); and state information of the apparatuses 50. Each of the information control central apparatus 20 and the information control terminal apparatus 40 includes a CPU, a storing unit, a communication interface, and the like not shown in the figure and operates according to predetermined software to realize functions thereof.

The motorman's cab display apparatuses 10 are provided in motorman's cabs of the car number one, which is the first car, and the car number n, which is the last car, as man-machine interfaces of the train information control system 1. The motorman's cab display apparatus 10 is connected to the information control central apparatus 20 by a transmission path for display apparatus 30. If a conductor's compartment is provided in a car other than the car number n, a motorman's cab display apparatus having functions same as the functions of the motorman's cab display apparatus 10 is provided in the conductor's compartment. The motorman's cab display apparatus is connected to the information control terminal apparatus 40 in the car in which the conductor's compartment is provided. Consequently, the first embodiment can be applied to the motorman's cab display apparatus mounted on the car other than both the end cars.

The motorman's car display apparatus 10 can display train information including the states of the apparatuses 50, for example, an opening and closing state of the door, brake pressure, temperature in the car, train speed, and a congestion degree in the car. A crew member can grasp the states of the apparatuses 50 according to display contents of the motorman's cab display apparatus 10. The crew member can input control information using input unit (not shown in the figure) provided in the motorman's cab display apparatus 10 and control the apparatuses 50. The input unit can be a touch panel or the like provided on a display screen.

A transmission path configuration of the train information control system 1 shown in FIG. 1 shows an example. A system configuration that takes redundancy into account is also possible. For example, the information control central apparatus 20 and the information control terminal apparatus 40 can be configured as a double system.

For example, an LCD (Liquid Crystal Display) is used as a display device of the motorman's cab display apparatus 10. The display device is required to have high luminance taking visibility into account in the motorman's car or the conductor's compartment in the daytime. On the other hand, at night or during tunnel traveling, the display device is too bright at display luminance same as the display luminance in the daytime and the visibility is poor. Therefore, it is desirable to reduce luminance depending on a time of a day or a traveling location.

Figure 2:
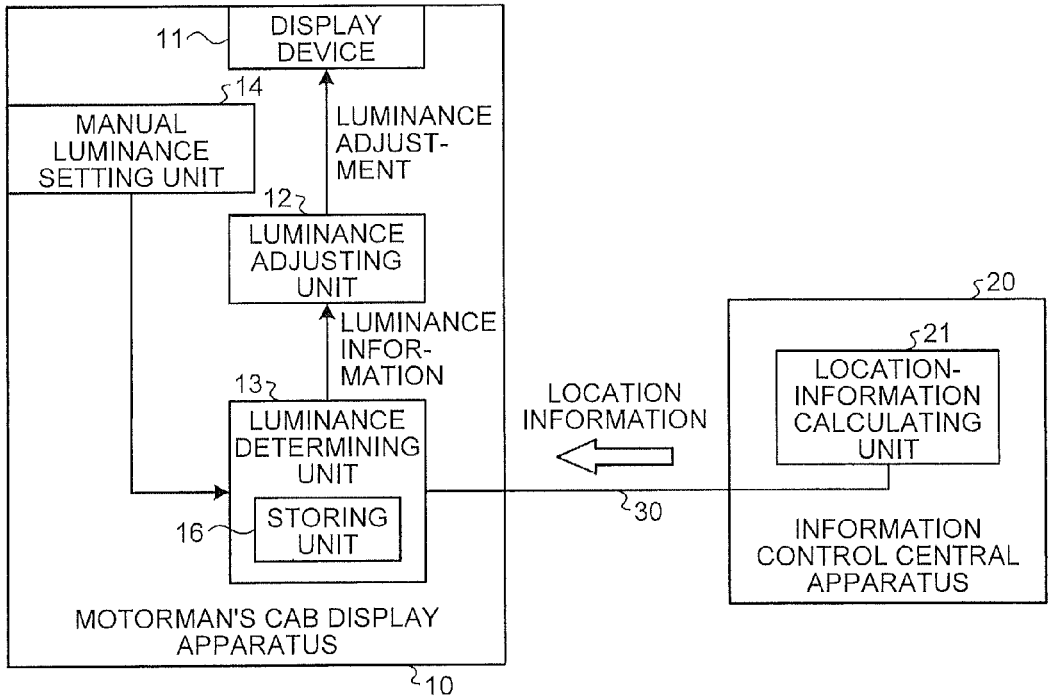
FIG. 2 is a diagram in which a schematic configuration of a motorman's cab display apparatus 10 according to the first embodiment is mainly shown.
Figure 3:
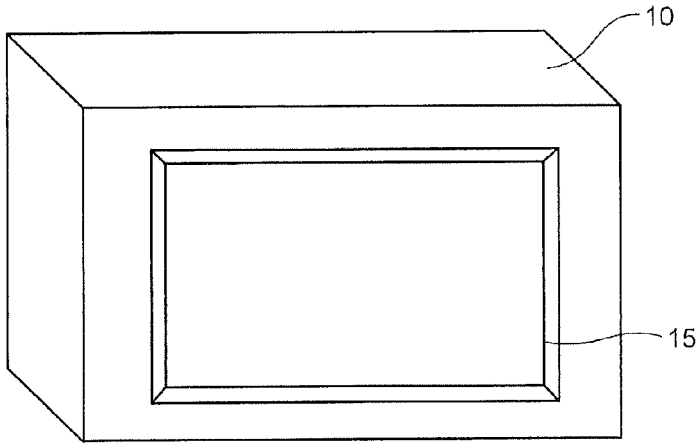
FIG. 3 is a schematic diagram of the motorman's cab display apparatus 10.

FIG. 2 is a diagram in which a schematic configuration of the motorman's cab display apparatus 10 according to the first embodiment is mainly shown and the motorman's cab display apparatus 10 and the information control central apparatus 20 are depicted. FIG. 3 is a schematic diagram of the motorman's cab display apparatus 10 and depicts a display screen 15 provided in the motorman's cab display apparatus 10.

As illustrated in FIG. 2, the information control central apparatus 20 includes a location-information calculating unit 21. The motorman's cab display apparatus 10 includes a display device 11, a luminance adjusting unit 12, a luminance determining unit 13, and a manual luminance setting unit 14.

The location-information calculating unit 21 calculates the location of the train. For example, the location-information calculating unit 21 calculates kilometrage information, which is a distance from a reference point (e.g., a departure station). The location-information calculating unit 21 calculates kilometrage based on, for example, the number of revolutions of an axle and a wheel diameter and periodically transmits the calculated kilometrage information to the luminance determining unit 13 of the motorman's cab display apparatus 10.

The luminance determining unit 13 has, in advance, kilometrage information (location information) of both ends of a tunnel section in, for example, a storing unit 16 incorporated therein. The luminance determining unit 13 compares kilometrage information, which is present location information of the train, transmitted from the location-information calculating unit 21 and the kilometrage information at both the ends of the tunnel section to thereby determine whether the train is traveling (or on the track) in the tunnel. The storing unit 16 may be provided on the outside of the luminance determining unit 13 and connected to the luminance determining unit 13.

The luminance determining unit 13 has, in the storing unit 16, for example, luminance information for daytime and luminance information for inside of tunnel set in advance. The luminance information is information for determining the luminance of the display screen 15 of the display device 11. Luminance for inside-of-tunnel (Lt1) is set lower than luminance for daytime (L1) such that a screen is not too bright in the tunnel and visibility is not deteriorated. The luminance for daytime L1 is a default luminance value mainly used in the daytime. In the first embodiment, luminance to be automatically set is only the luminance for daytime and the luminance for inside of tunnel. Therefore, the luminance for daytime may also be considered luminance for outside of tunnel.

When determining based on the kilometrage information representing the traveling location of the train received from the location-information calculating unit 21 that the train is traveling outside the tunnel, the luminance determining unit 13 sends the luminance information for daytime (i.e., data of the luminance L1) to the luminance adjusting unit 12. When determining that the train is traveling in the tunnel, the luminance determining unit 13 sends the luminance information for inside of tunnel (i.e., data of the luminance Lt1) to the luminance adjusting unit 12. For example, when kilometrages at both ends of the tunnel section are represented as A and B ($A<B$) and kilometrage received from the location-information calculating unit 21 is represented as K, if $A \leq K \leq B$, the luminance determining unit 13 determines that the train is present in the tunnel. Otherwise, the luminance determining unit 13 determines that the train is present outside the tunnel.

Specifically, during the startup of the motorman's cab display apparatus 10, the luminance determining unit 13 transmits the luminance information for daytime to the luminance adjusting unit 12 as an initial setting value. The luminance adjusting unit 12 sets the luminance of the display screen 15 of the display device 11 to the luminance for daytime L1 according to the obtained luminance information. Further, when the train enters the tunnel section (at the kilometrage A), the luminance determining unit 13 transmits the luminance information for inside of tunnel to the luminance adjusting unit 12. The luminance adjusting unit 12 sets the luminance of the display screen 15 of the display device 11 to the luminance for inside of tunnel Lt1 according to the obtained luminance information. The luminance determining unit 13 stores in advance luminance information of the display screen 15 immediately before the entry into the tunnel section in the storing unit 16. Further, when the train exits the tunnel section (at kilometrage B), the luminance determining unit 13 transmits the luminance information immediately before the entry into the tunnel stored in the storing unit 16 to the luminance adjusting unit 12. The luminance adjusting unit 12 sets the luminance of the display screen 15 of the display device 11 to luminance immediately before the entry into the tunnel (in this case, the luminance for daytime L1) according to the obtained luminance information.

The kilometrages A and B representing both the ends of the tunnel section can also be set with positive or negative margins given thereto from the locations of actual tunnel ends. Consequently, timing for switching luminance can be set to desired timing such as immediately before or immediately after the entry into the tunnel or immediately before or immediately after the exit from the tunnel. For example, when the kilometrage A is set to a predetermined distance before the starting end of the tunnel, the luminance determining unit 13 can transmit the luminance information for inside of tunnel to the luminance adjusting unit 12 immediately before the train enters the tunnel.

The luminance adjusting unit 12 can set the luminance of the display screen 15 of the display device 11 to the luminance for inside of tunnel Lt1 according to the obtained luminance information.

The luminance determining unit 13 includes a CPU (not shown in the figure) and the like in addition to the storing unit 16. The luminance determining unit 13 realizes functions thereof by operating according to predetermined software. The luminance adjusting unit 12 performs adjustment of the luminance of the display device 11 by adjusting, for example, a current value (or a voltage value) of a backlight of the display device 11 according to the luminance information obtained from the luminance determining unit 13.

Further, as shown in FIG. 2, the manual luminance setting unit 14 is provided in the motorman's cab display apparatus 10. The manual luminance setting unit 14 is a unit for manually inputting luminance setting information.

The manual luminance setting unit 14 makes it possible to manually set the luminance of the display screen 15 of the display device 11. The manual luminance setting unit 14 may be configured by, for example, a volume adjusting switch or a touch device. For example, when the crew member feels that automatically-set luminance is too bright or too dark, the crew member can input and set desired luminance by operating the manual luminance setting unit 14. The set luminance information is transmitted to the luminance adjusting unit 12 via the luminance determining unit 13, and the luminance of the display screen 15 of the display device 11 is changed. The luminance change by the manual luminance setting unit 14 has higher priority over luminance setting by automatic adjustment. The manual luminance setting unit 14 includes a function of resetting the manually-set luminance and returning the manual setting to automatic setting. A configuration in which the manual luminance setting unit 14 is not provided is also possible.

Figure 4:
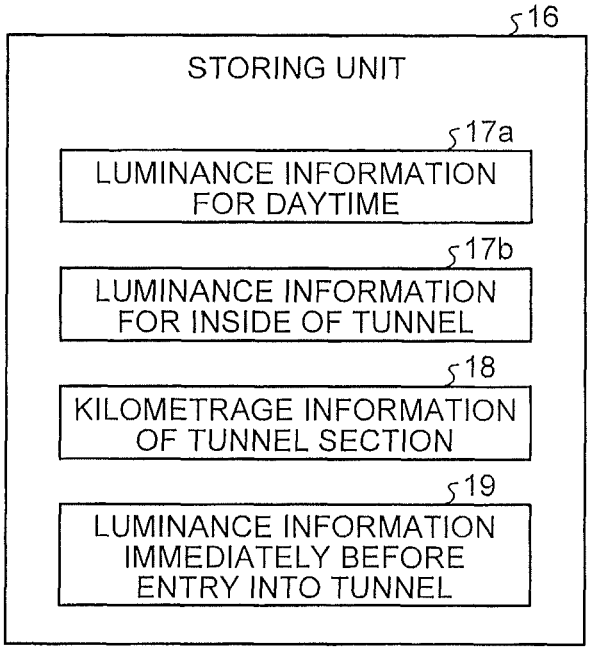
FIG. 4 is a diagram of an example of stored contents of a storing unit 16.

The luminance determining unit 13 records in advance the luminance information immediately before the entry into the tunnel section in the storing unit 16 such that, even when the crew member manually adjusts luminance (e.g., reduces luminance) before the train enters the tunnel section, after the train exits the tunnel section, luminance returns to the luminance adjusted by the crew member before the train enters the tunnel section. FIG. 4 is a diagram of an example of stored contents in the storing unit 16. In the example shown in the figure, the storing unit 16 has stored therein luminance information for daytime 17*a*, luminance information for inside of tunnel 17*b*, kilometrage information 18 of tunnel section, and luminance information immediately before entry into tunnel 19.

Figure 5:
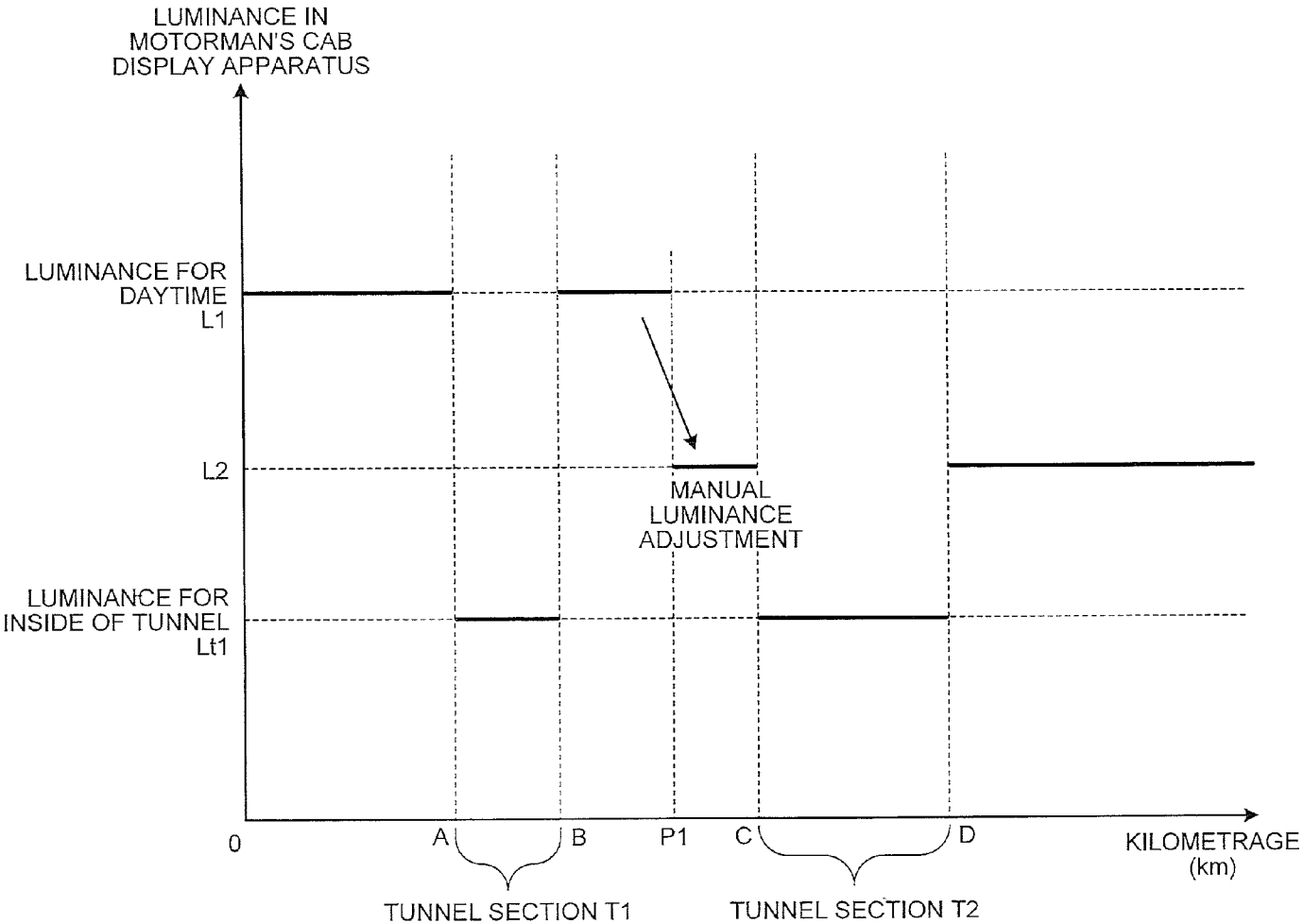
FIG. 5 is a diagram of an example of luminance in the motorman's cab display apparatus 1 with respect to a change in kilometrage.

FIG. 5 is a diagram of an example of luminance in the motorman's cab display apparatus 10 with respect to a change in kilometrage. Specifically, in FIG. 5, a state is shown in which the luminance of the display screen 15 of the motorman's cab display apparatus 10 changes according to an increase in kilometrage in the train traveling in the daytime.

As shown in FIG. 5, first, when the train reaches the kilometrage A at a starting end of a tunnel section T1, the motorman's cab display apparatus 10 adjusted to the luminance for daytime L1 reduces the luminance of the display screen 15 to the luminance for inside of tunnel Lt1. When the train reaches the kilometrage B at a terminal end of the tunnel section T1, the motorman's cab display apparatus 10 resets the luminance of the display screen 15 to the luminance for daytime L1. As explained above, such luminance control is performed by the luminance determining unit 13. Specifically, the luminance determining unit 13 compares present location information of the train obtained from the location-information calculating unit 21 and the kilometrage information 18 of the tunnel section T1 stored in the storing unit 16 in advance and outputs kinds of luminance information respectively corresponding to a start point and an end point of the tunnel section T1 to the luminance adjusting unit 12 at the start point and the end point. The luminance adjusting unit 12 adjusts the luminance of the display screen 15 according to the obtained luminance information.

It is assumed that the motorman feels the display screen 15 dazzling because of a change of the weather and, for example, reduces the luminance of the display screen 15 by operating the manual luminance setting unit 14. Kilometrage at this point is represented as P1 and the manually-set luminance is represented as L2 (FIG. 5). Thereafter, when the train reaches kilometrage C at a starting end of a tunnel section T2, the motorman's cab display apparatus 10 reduces the luminance of the display screen 15 to the luminance for inside of tunnel Lt1. This means that L1>L2>Lt1. When the train reaches kilometrage D at a terminal end of the tunnel section T2, the motorman's cab display apparatus 10 resets the luminance of the display screen 15 to the luminance adjusted by the motorman before the kilometrage C at the starting end of the tunnel section T2 (i.e., the luminance L2). This is control that can be performed because the luminance determining unit 13 stores the manually-set luminance information in the storing unit 16 as the luminance information immediately before entry into tunnel 19.

Figure 6:
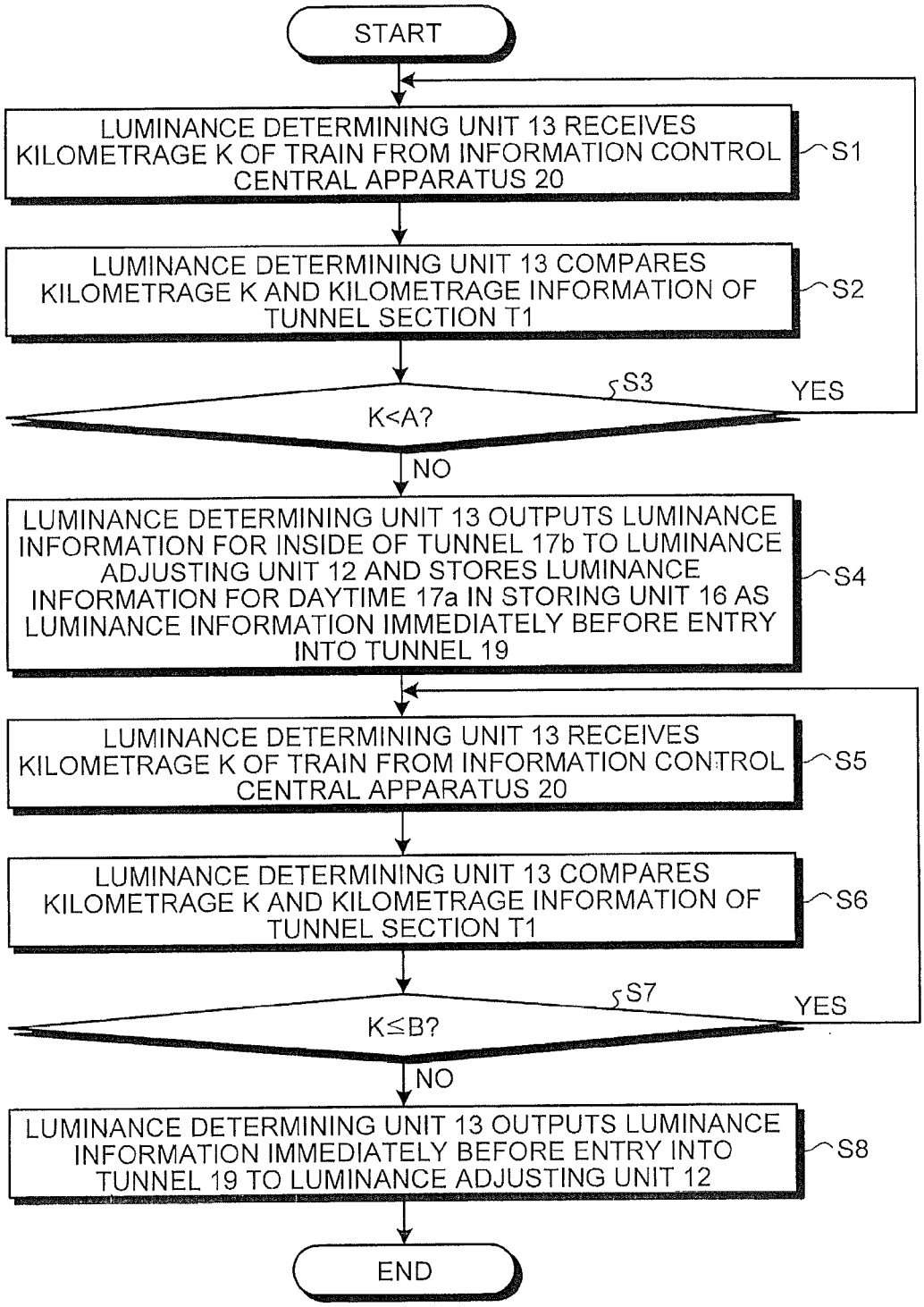
FIG. 6 is a flowchart for explaining the operation of the motorman's cab display apparatus 10 from time before entry into a tunnel section T1 shown in FIG. 5 until time after exit from the tunnel section T1.

FIG. 6 is a flowchart for explaining the operation of the motorman's cab display apparatus 10 from time before the entry into the tunnel section T1 shown in FIG. 5 until time after exit from the tunnel section T1. The luminance of the display screen 15 of the motorman's cab display apparatus 10 is initially set to the luminance L1 for the daytime.

As shown in FIG. 6, the luminance determining unit 13 receives the kilometrage K from the information control central apparatus 20 as location information of the train (S1). The information control central apparatus 20 periodically transmits location information to the luminance determining unit 13.

Subsequently, the luminance determining unit 13 compares the kilometrage K and kilometrage information of the tunnel section T1 (S2) and determines whether K<A (S3). The kilometrages A and B are included in the kilometrage information of tunnel section 18.

When determining that K<A (Yes at S3), the luminance determining unit 13 repeats the processing at S1 to S2. On the other hand, when determining that A≤K (No at S3), the luminance determining unit 13 determines that the train has entered the tunnel section T1, outputs the luminance information for inside of tunnel 17*b* to the luminance adjusting unit 12, and stores the luminance information for daytime 17*a* in the storing unit 16 as the luminance information immediately before entry into tunnel 19 (S4). The luminance adjusting unit 12 sets the luminance of the display screen 15 of the display device 11 to the luminance for inside of tunnel Lt1.

Subsequently, the luminance determining unit 13 receives the kilometrage K as location information of the train from the information control central apparatus 20 (S5), compares the kilometrage K and the kilometrage information of the tunnel section T1 (S6), and determines whether K≤B (S7).

When determining that K≤B (Yes at S7), the luminance determining unit 13 determines that the train is moving in the tunnel section T1 and repeats the processing at S5 to S6.

Specifically, the luminance determining unit 13 performs the luminance adjustment at timing when the train enters the tunnel section T1. However, thereafter, unless manual adjustment is performed, the luminance determining unit 13 does not perform the luminance adjustment until the train exits the tunnel section T2. On the other hand, when determining that K>B (No at S7), the luminance determining unit 13 determines that the train has exited the tunnel section T1 and outputs the luminance information immediately before entry into tunnel 19 to the luminance adjusting unit 12 (S8). Consequently, the luminance adjusting unit 12 can reset the luminance of the display screen 15 of the display device 11 to the luminance L1 immediately before the entry into the tunnel section T1.

Figure 7:
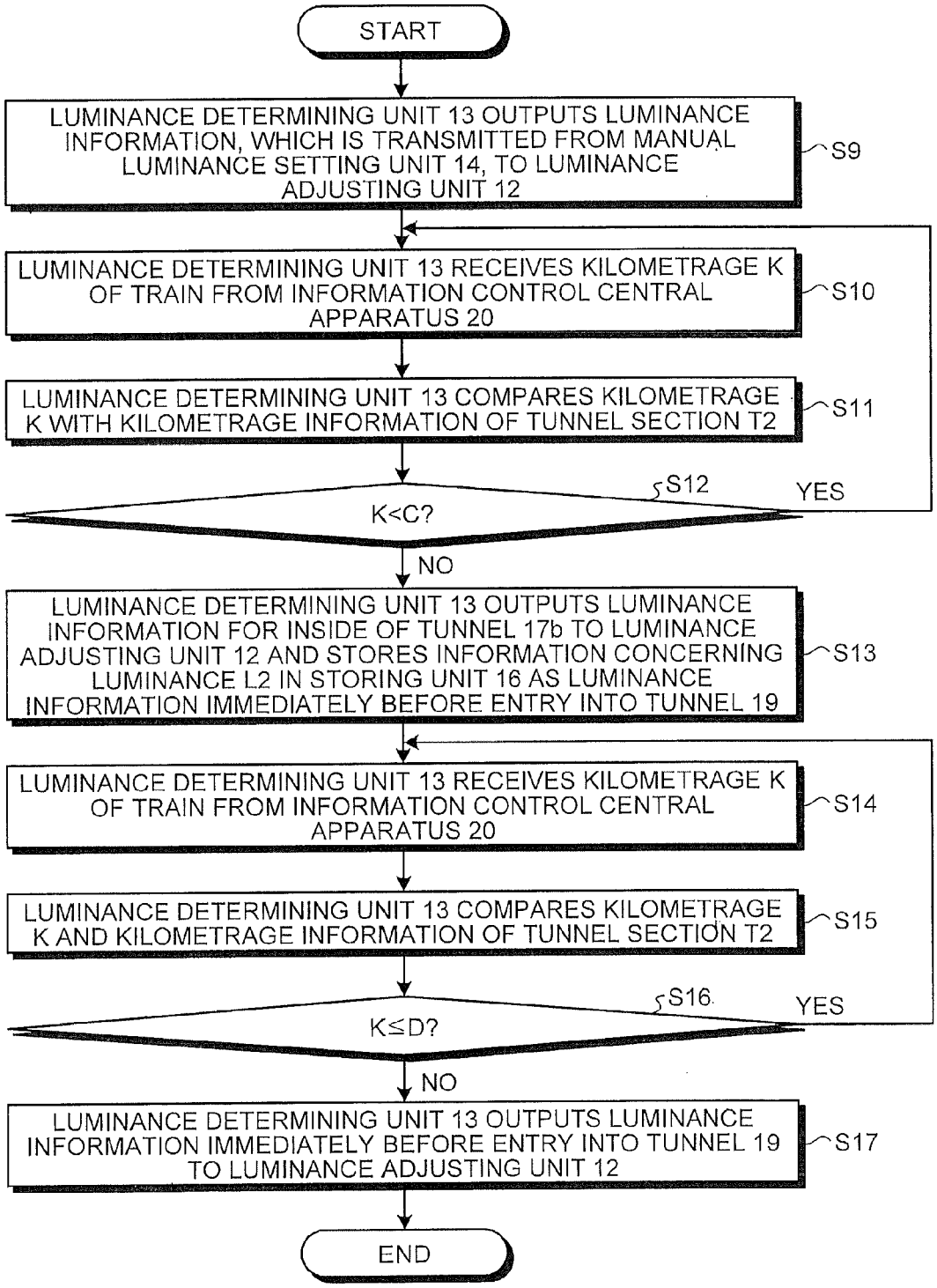
FIG. 7 is a flowchart for explaining the operation of the motorman's cab display apparatus 10 after the exit from the tunnel section T1 shown in FIG. 5 until passage of a tunnel section T2 and is a figure following FIG. 6.

FIG. 7 is a flowchart for explaining the operation of the motorman's cab display apparatus 10 from time before the entry into the tunnel section T2 shown in FIG. 5 until time after exit from the tunnel section T2 and is a flowchart continued from FIG. 6.

When luminance setting is performed via the manual luminance setting unit 14 at the point of the kilometrage P1, the manual luminance setting unit 14 outputs set luminance information to the luminance adjusting unit 12. The luminance determining unit 13 outputs the luminance information, which is transmitted from the manual luminance setting unit 14, to the luminance adjusting unit 12 (S9). The luminance adjusting unit 12 sets the luminance of the display screen 15 to L2 according to the obtained luminance information.

Subsequently, the luminance determining unit 13 receives the kilometrage K from the information control central apparatus 20 as location information of the train (S10). The luminance determining unit 13 compares the kilometrage K with kilometrage information of the tunnel section T2 (S11) and determines whether K<C (S12). Kilometrages C and D are included in the kilometrage information 18 of tunnel section.

When determining that K<C (Yes at S12), the luminance determining unit 13 repeats the processing at S10 to S11. On the other hand, when determining that C≤K (No. at S12), the luminance determining unit 13 determines that the train has entered the tunnel section T2, outputs the luminance information for inside of tunnel 17*b* to the luminance adjusting unit 12, and stores information concerning the manually-set luminance L2 in the storing unit 16 as the luminance information immediately before entry into tunnel 19 (S13). The luminance information immediately before entry into tunnel 19 includes information indicating that the luminance is L2 and is the manually-set luminance. The luminance adjusting unit 12 sets the luminance of the display screen 15 of the display device 11 to the luminance for inside of tunnel Lt1.

Subsequently, the luminance determining unit 13 receives the kilometrage K from the information control central apparatus 20 as location information of the train (S14), compares the kilometrage K and the kilometrage information of the tunnel section T2 (S15), and determines whether K≤D (S16).

When determining that K≤D (Yes at S16), the luminance determining unit 13 determines that the train is moving in the tunnel section T2 and repeats the processing at S14 to S15. On the other hand, when determining that K>D (No at S16), the luminance determining unit 13 determines that the train has exited the tunnel section T2 and outputs the luminance information immediately before entry into tunnel 19 to the luminance adjusting unit 12 (S17). Consequently, the luminance adjusting unit 12 can reset the luminance of the display screen 15 of the display device 11 to the luminance L2 immediately before the entry into the tunnel section T2.

As explained above, according to the first embodiment, by using the kilometrage information of the train information control system 1, it is possible to perform the automatic luminance adjustment for the motorman's cab display apparatus 10 according to the inside and the outside of the tunnel without adding a new device or component such as a luminance sensor.

According to the first embodiment, it is possible to manually set desired luminance from automatically-set luminance by providing the manual luminance setting unit 14.

In the above explanation, as the precondition, the motorman's cab display apparatus 10 of the car number one, which is the first car, and the motorman's cab display apparatus 10 of the car number n, which is the last car, switch the luminance of the display screens 15 at the same timing when the train enters a tunnel section or when the train exits the tunnel section. However, actually, the calculation of kilometrage by the location-information calculating unit 21 is performs with reference to, for example, the location of the first car. Therefore, if the luminances in both the motorman's cab display apparatuses 10 of the car number one and the car number n are simultaneously switched to the luminance for inside of tunnel Lt1 when the first car reaches the starting end of the tunnel section, display is performed at the luminance for inside of tunnel Lt1 regardless of the fact that the inside of the car number n actually has brightness in the daytime. Therefore, there is a problem in that the visibility is deteriorated. A similar problem occurs when the train exits the tunnel section.

Therefore, it is desirable to calculate a time difference between time when the first car reaches the starting end of the tunnel section and time when the last car reaches the starting end and delay timing of switching of the luminance of the display screen 15 of the motorman's cab display apparatus 10 of the last car by the time difference.

Specifically, timing of switching of the luminance of the display screen 15 when the train enters the tunnel section and when the train exits the tunnel section is adjusted as explained below. For example, when the train enters the tunnel section, the luminance determining unit 13 of the motorman's cab display apparatus 10 of the car number n, which is the last car, determines, based on kilometrage information from the location-information calculating unit 21, a point when the train has reached the starting end of the tunnel section (accurately, determines a point when the car number one, which is the first car, has reached the starting end). Further, the luminance determining unit 13 calculates, by dividing formation length D (=the number of cars×car length) by speed V of the train at that point, a predicted time difference until the last car reaches the location of the first car at the timing of the determination. After determining that the car number one, which is the first car, has reached the starting end, the luminance determining unit 13 of the motorman's cab display apparatus 10 of the car number n outputs the luminance information for inside of tunnel to the luminance adjusting unit 12 when time elapses by the predicted time difference D/V. Consequently, the luminance adjusting unit 12 can change the luminance of the display screen 15 from the luminance for daytime L1 to the luminance for inside of tunnel Lt1 at timing when the last car has actually reached the starting end of the tunnel section.

Speed information and formation length information of the train used for the calculation of the predicted time difference D/V by the luminance determining unit 13 are given by the information control central apparatus 20. In other words, the information control central apparatus 20 manages the speed information (train speed), the number of cars of a formation, and the car length of the train as train information. The information control central apparatus 20 periodically transmits the speed information of the train to the luminance determining unit 13 together with location information. The information control central apparatus 20 transmits the number of cars of the formation and the car length information to the luminance determining unit 13, for example, after constructing the formation. The luminance determining unit 13 stores the number of cars of the formation and the car length information in the storing unit 16.

The same applies when the train exits from the tunnel section. Specifically, after the train enters the tunnel section, the luminance determining unit 13 of the motorman's cab display apparatus 10 of the car number n, which is the last car, determines, based on kilometrage information from the location-information calculating unit 21, a point when the train has reached the terminal end of the tunnel section (accurately, determines a point when the car number one, which is the first car, has reached the terminal end). Further, the luminance determining unit 13 calculates, by dividing the formation length D (=the number of cars×car length) by the speed V of the train at that point, a predicted time difference until the last car reaches the location of the first car at the timing of the determination. After determining that the car number one, which is the first car, has reached the terminal end, the luminance determining unit 13 of the motorman's cab display apparatus 10 of the car number n outputs the luminance information immediately before entry into tunnel 19 to the luminance adjusting unit 12 when time elapses by the predicted time difference D/V. Consequently, the luminance adjusting unit 12 can change the luminance of the display screen 15 from the luminance for inside of tunnel Lt1 to the luminance immediately before entry into tunnel at timing when the last car has actually reached the terminal end of the tunnel section.

In the example (FIG. 5) explained above, the manual luminance adjustment is performed outside the tunnel. However, the manual luminance adjustment can also be performed in the tunnel. Specifically, for example, when the crew member feels that automatically-set luminance for inside of tunnel Lt2 is too high or too low while the train is traveling in the tunnel, the crew member can set desired luminance by operating the manual luminance setting unit 14. The set luminance information is transmitted to the luminance adjusting unit 12 through the luminance determining unit 13. The luminance of the display screen 15 of the display device 11 is changed.

The luminance determining unit 13 can record information concerning the luminance for inside of tunnel manually set in this way (the luminance is represented as Lt2) in the storing unit 16 and perform control to set the luminance Lt2 in the next tunnel section. In general, illuminances in tunnels are considered to be substantially the same. Therefore, the luminance for inside of tunnel Lt1 manually set by the crew member is expected to be suitable luminance in tunnels thereafter at least for the above mentioned crew member. Therefore, except when luminance setting is performed again by the crew member in the tunnels or the manual setting is reset and switched to automatic setting, during operation on the track, it is desirable that the luminance for inside of tunnel once set is stored and used as the luminance of the display screen 15 in tunnels that the train passes thereafter. However, the luminance determining unit 13 does not have to record the information concerning the manually-set luminance for inside of tunnel Lt2 in the storing unit 16. The manual setting can be configured to be effective only in the tunnel for which the luminance for inside of tunnel is set.

Figure 8:
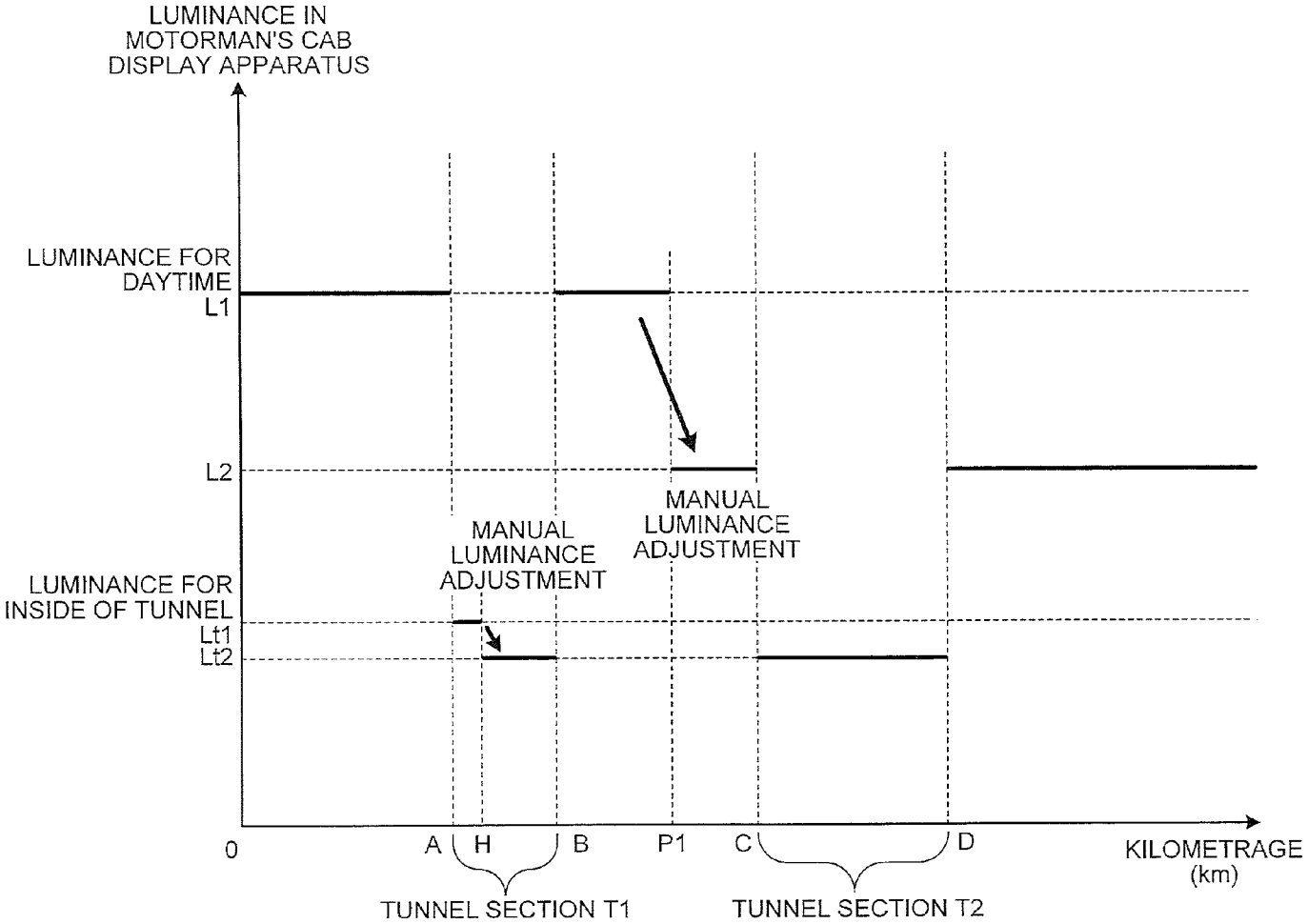
FIG. 8 is a diagram in which an example of luminance obtained when manual luminance adjustment is performed in a tunnel section is shown together with a change in kilometrage.

FIG. 8 is a diagram in which an example of luminance obtained when manual luminance adjustment is performed in a tunnel section is shown together with a change in kilometrage. As shown in FIG. 8, at kilometrage H in the tunnel section T1, the luminance of the display screen 15 is manually reduced from the luminance for inside of tunnel Lt1 to the luminance for inside of tunnel Lt2. The manually-set luminance for inside of tunnel Lt2 is continuously used in the next tunnel section T2. This is because the luminance determining unit 13 records information concerning the luminance Lt2, which is manually set in the tunnel section T1, as a part of the luminance information for inside of tunnel 17*b* and, in the tunnel section T2, by referring to the luminance information for inside of tunnel 17*b*, outputs the information concerning the manually-set luminance Lt2 to the luminance adjusting unit 12 and performs luminance control. In other words, the luminance information for inside of tunnel 17*b* includes the information concerning the luminance Lt2 when luminance is manually set together with the information concerning the automatically-set luminance for inside of tunnel Lt1.

Second Embodiment

In the first embodiment, the motorman's cab display apparatus 10 is explained that performs the luminance adjustment according to whether the traveling location of the train is in the tunnel section. In the second embodiment, the motorman's cab display apparatus 10 performs luminance adjustment taking into account not only a traveling section but also time information. In the first embodiment, while the train is traveling outside the tunnel, the luminance of the display screen 15 is set to the luminance for daytime except luminance set by the manual setting. However, for example, when the train is traveling at night, it is desirable to apply luminance for night as the luminance of the display screen 15. For example, when the train is traveling in the evening or in the morning, because it is dim for, for example, about one hour before and after the sunset and the sunrise, it is desirable to apply luminance for evening or for morning in the dim period of time. Therefore, in the second embodiment, in addition to the luminance adjusting mechanism in the first embodiment, a function of switching luminance for daytime, luminance for evening (or for morning), and luminance for night according to a period of time is provided.

Figure 9:
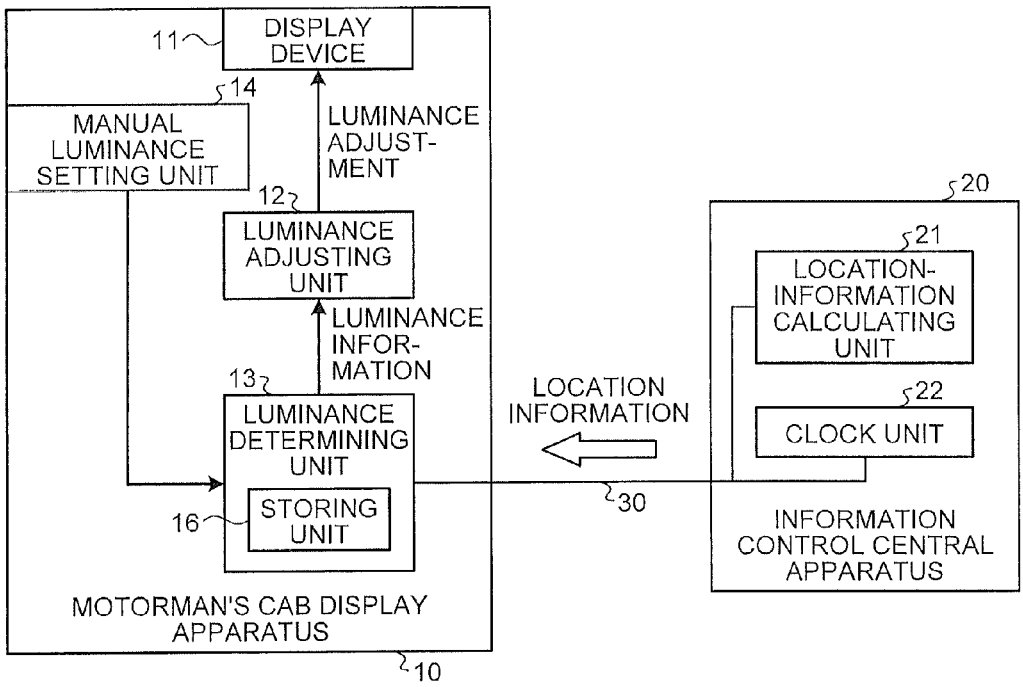
FIG. 9 is a diagram in which a schematic configuration of the motorman's cab display apparatus 10 according to a second embodiment is mainly shown.

FIG. 9 is a diagram in which a schematic configuration of the motorman's cab display apparatus 10 according to the second embodiment is mainly shown. The motorman's cab display apparatus 10 and the information control central apparatus 20 are shown. As shown in FIG. 9, the information control central apparatus 20 includes the location-information calculating unit 21 and a clock unit 22. The motorman's cab display apparatus 10 includes the display device 11, the luminance adjusting unit 12, the luminance determining unit 13, and the manual luminance setting unit 14. In FIG. 9, components same as those in FIG. 2 are denoted by the same reference numerals and signs and detailed explanation of the components is omitted, and differences from FIG. 2 are explained below.

The clock unit 22 outputs time information (e.g., year, month, day, hour, minute, and second). The clock unit 22 periodically transmits the time information to the luminance determining unit 13 of the motorman's cab display apparatus 10 via the transmission path for display apparatus 30. Similarly to the first embodiment, the location-information calculating unit 21 periodically transmits location information (kilometrage information) to the luminance determining unit 13 of the motorman's cab display apparatus 10 via the transmission path for display apparatus 30.

Figure 10:
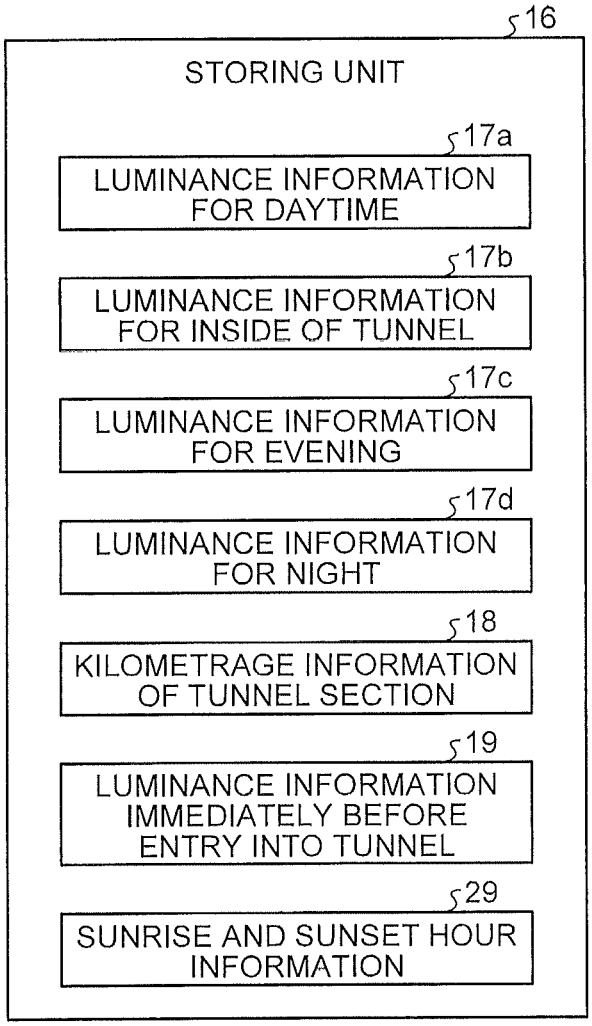
FIG. 10 is a diagram of an example of stored contents of the storing unit 16 of a luminance determining unit 13 in the second embodiment.

FIG. 10 is a diagram of an example of stored contents in the storing unit 16 of the luminance determining unit 13. As shown in FIG. 10, the storing unit 16 has stored therein the luminance information for daytime 17*a*, the luminance information for inside of tunnel 17*b*, luminance information for evening 17*c*, luminance information for night 17*d*, the kilometrage information of tunnel section 18, the luminance information immediately before entry into tunnel 19, and sunrise and sunset hour information 29.

The luminance information for evening 17*c* is used for luminance setting in a period of time in the evening or the morning. In other words, in the second embodiment, the same luminance is set for both of a period of time in the evening and a period of time in the morning based on the luminance information for evening 17*c*. It is also possible to set luminance information for morning in addition to the luminance information for evening 17*c* and set different luminances for the period of time in the evening and the period of time in the morning. In the second embodiment, the luminance information for night 17*d* includes content same as content of the luminance information for inside of tunnel 17*b*. Luminance for night is set to luminance same as luminance for inside of tunnel. The luminance for night and the luminance for inside of tunnel may be set to luminances different from each other. The luminance for evening is set lower than the luminance for daytime and higher than the luminance for inside of tunnel and the luminance for night.

The sunrise and sunset hour information 29 is information for giving sunrise and sunset hours corresponding to month and day. When a traveling range of a train extends in a wide range, for example, when the train travels in a wide range to the east and west (e.g., a limited express train), sunrise or sunset hour is different according to a traveling location even in the same day. In such a case, the sunrise and sunset hour information 29 further gives sunrise and sunset hours corresponding to month and day for each traveling location (e.g., kilometrage) of the train. In other words, the sunrise and sunset hour information 29 is given as table information of sunrise and sunset hours or table information in which sunrise and sunset hours are given for each kilometrage.

The sunrise and sunset hour information 29 is used for classification of a period of time in the daytime, a period of time in the evening or the morning, and a period of time at night. For example, when one hour before and after the sunset and the sunrise is defined as a period of time in the evening or the morning, a period from time after one hour elapses after the sunset until time one hour before the sunrise is can be set as a period of time at night. A period of time other than the periods of time in the evening, in the morning, and at night can be set as a period of time in the daytime. Time width for defining the period of time in the evening or the morning can be arbitrarily set as a predetermined range. Classification of the period of time in the morning, the period of time in the daytime, the period of time in the evening, and the period of time at night is not limited to the classification using the sunrise and sunset hour information 29. The luminance determining unit 13 only has to have setting information of periods of time defined in advance. The other information of the storing unit 16 is the same as that shown in FIG. 4.

As explained in the first embodiment, the luminance determining unit 13 determines, based on kilometrage information received from the location-information calculating unit 21, whether the train is traveling in a tunnel or traveling outside the tunnel. When determining that the train is traveling in the tunnel, the luminance determining unit 13 outputs the luminance information for inside of tunnel 17*b* to the luminance adjusting unit 12.

On the other hand, when determining that the train is traveling outside the tunnel, the luminance determining unit 13 compares present time information received from the clock unit 22 with the sunrise and sunset hour information 29 of the storing unit 16 and determines whether the present time belongs to the period of time in the daytime, belongs to the period of time in the evening or the morning, or belongs to the period of time at night. In the determination, when the sunrise and sunset hour information 29 is given according to kilometrage as well, the luminance determining unit 13 specifies, based on kilometrage information received from the location-information calculating unit 21, sunrise and sunset hours corresponding to kilometrage of the train from the sunrise and sunset hour information 29 and determines which of the periods of time in the morning, the daytime, the evening, and night the sunrise and sunset hours belong. In the following explanation, the sunrise and sunset hours are substantially fixed irrespective of a traveling location of the train. However, the same explanation applies when the sunrise and sunset hours depend on the traveling location of the train.

As a result of the determination of the period of time, for example, when the present time belongs to the period of time in the daytime, the luminance determining unit 13 outputs the luminance information for daytime 17*a* to the luminance adjusting unit 12. When the present time belongs to the period of time in the evening or the morning, the luminance determining unit 13 outputs the luminance information for evening 17*c* to the luminance adjusting unit 12. Further, when the present time belongs to the period of time at night, the luminance determining unit 13 outputs the luminance information for night 17*d* to the luminance adjusting unit 12. The luminance adjusting unit 12 sets the luminance of the display screen 15 of the display device 11 according to the obtained luminance information.

As explained above, in the luminance adjustment by the luminance determining unit 13, the luminance control based on location information (specifically, determination whether the train is inside or outside a tunnel section) has priority over the luminance control based on time.

Figure 11:
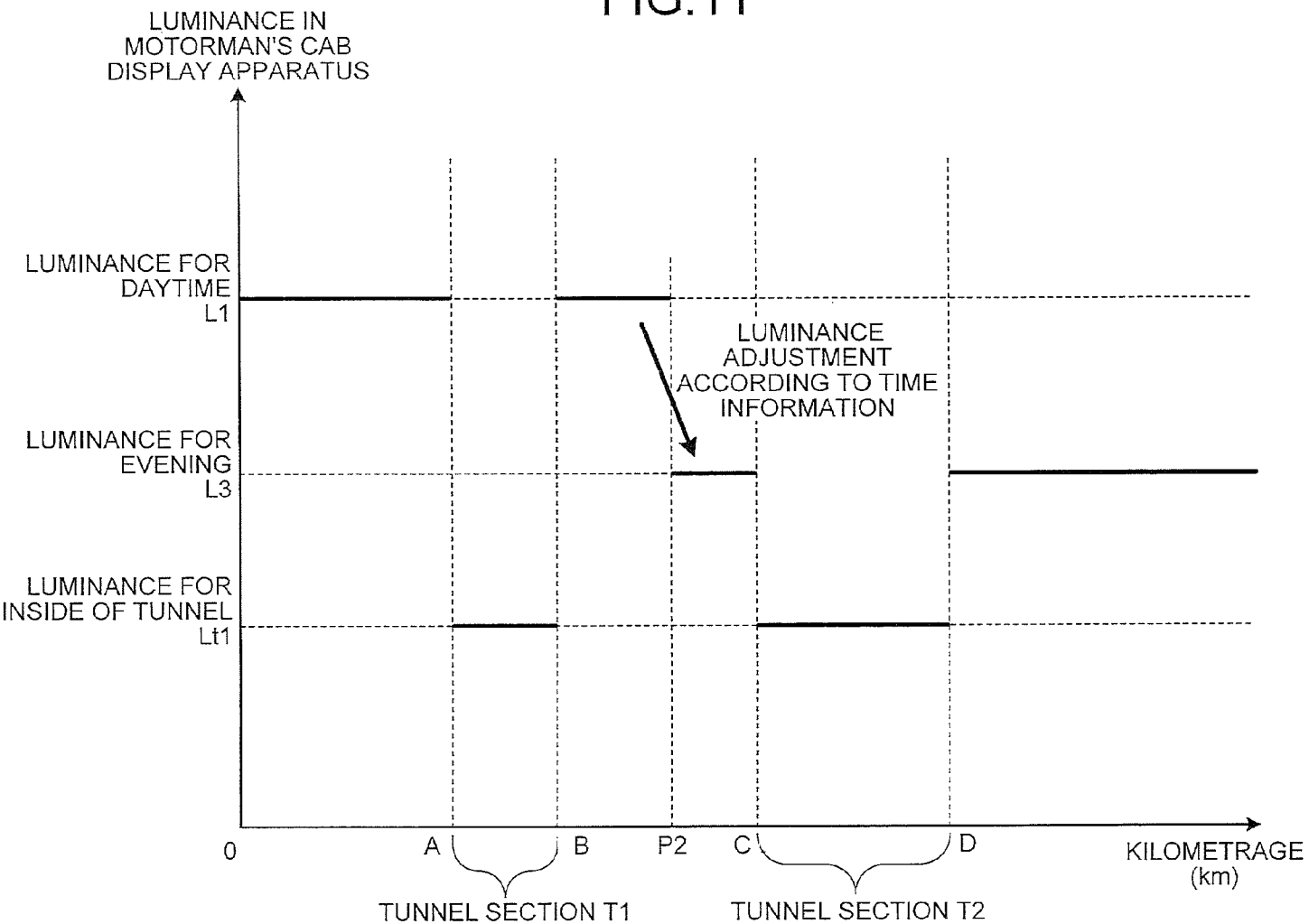
FIG. 11 is a diagram of an example of a state in which luminance of a display screen 15 of the motorman's cab display apparatus 10 changes according to an increase in kilometrage in a train traveling in a period of time when the daytime changes to evening.

FIG. 11 is a diagram of a state in which the luminance of the display screen 15 of the motorman's cab display apparatus 10 changes according to an increase in kilometrage in a train traveling in a period of time when the daytime changes to the evening. In FIG. 11, a period of time before a point when the train reaches kilometrage P2 is the period of time in the daytime and a period of time after that is the period of time in the evening. Luminances before and after the tunnel section T1 are the same as those in FIG. 5. Specifically, as the luminance of the display screen 15, the luminance for daytime L1 is used up to the kilometrage A, the luminance for inside of tunnel Lt1 is used in the tunnel section T1, and the luminance for daytime L1 is set again after the kilometrage B.

Subsequently, the luminance determining unit 13 receives kilometrage information (the kilometrage K) from the location-information calculating unit 21 and receives present time information from the clock unit 22. First, the luminance determining unit 13 compares the kilometrage K and kilometrage information (the kilometrages C and D) of the tunnel section T2 and determines whether K<C. The kilometrages C and D are included in the kilometrage information 18 of tunnel section.

When determining that K<C, subsequently, the luminance determining unit 13 compares the time information and the sunrise and sunset hour information 29 and determines whether the present time belongs to the period of time in the daytime. As a result of the determination of the period of time, when the present time belongs to the period of time in the daytime, the luminance determining unit 13 determines that the train is traveling outside a tunnel and traveling in the period of time in the daytime. Because it is unnecessary to change the luminance of the display screen 15, the luminance determining unit 13 repeats, without performing new luminance setting, the comparison processing for kilometrage information and time information to be received next.

On the other hand, as a result of the determination of the period of time, when the present time belongs to the period of time in the evening, the luminance determining unit 13 determines that the train is traveling outside the tunnel and time enters the period of time in the evening from the period of time in the daytime. The luminance determining unit 13 outputs the luminance information for evening 17*c* to the luminance adjusting unit 12. Consequently, the luminance adjusting unit 12 sets the luminance of the display screen 15 to luminance for evening L3. When the present time belongs to the other periods of time, the luminance determining unit 13 performs processing for taking the same measures, for example, when the present time belongs to the period of time at night, the luminance determining unit 13 outputs the luminance information for night 17*d* to the luminance adjusting unit 12.

In FIG. 11, the luminance of the display screen 15 is the luminance for daytime L1 from the kilometrage B at the terminal end of the tunnel section T1 to the kilometrage P2. On the other hand, from the kilometrage P2 to the kilometrage C at the starting end of the tunnel section T2, the luminance of the display screen 15 is the luminance for evening L3. In other words, at the point of the kilometrage P2, the luminance adjusting unit 12 changes the luminance of the display screen 15 from the luminance for daytime L1 to the luminance for evening L3.

When the train reaches the kilometrage C at the starting end of the tunnel section T2, as a result of the determination of kilometrage, the luminance determining unit 13 determines that and outputs the luminance information for inside of tunnel 17*b* to the luminance adjusting unit 12. The luminance determining unit 13 records the luminance information for evening 17*c* in the storing unit 16 as the luminance information immediately before entry into tunnel 19.

Subsequently, the luminance determining unit 13 receives kilometrage information (the kilometrage K) from the location-information calculating unit 21 and receives present time information from the clock unit 22. The luminance determining unit 13 compares the kilometrage K with the kilometrage information (the kilometrages C and D) of the tunnel section T2 and determines whether K≤D. When determining that K≤D, the luminance determining unit 13 repeats the same comparison processing for kilometrage information to be received next.

On the other hand, when the train reaches the kilometrage D at the terminal end of the tunnel section T2, the luminance determining unit 13 determines that K>D. Further, the luminance determining unit 13 compares the time information with the sunrise and sunset hour information 29 and determines a period of time to which the present time belongs. In the example shown in the figure, the period of time does not change before and after the tunnel section T2. Both periods of time before and after the tunnel section T2 are the period of time in the evening. Therefore, the luminance determining unit 13 outputs the luminance information for evening 17*c* to the luminance adjusting unit 12. Consequently, the luminance adjusting unit 12 sets the luminance of the display screen 15 to the luminance for evening L3 in the same manner as before the entry into the tunnel.

In setting the luminance, the luminance determining unit 13 checks, referring to the luminance information immediately before entry into tunnel 19 stored in the storing unit 16, whether luminance set immediately before the entry into the tunnel is manually set. When the luminance set immediately before the entry into the tunnel is manually set, the luminance determining unit 13 outputs the luminance information immediately before entry into tunnel 19 to the luminance adjusting unit 12. On the other hand, when the luminance set immediately before the entry into the tunnel is not manually set, the luminance determining unit 13 outputs luminance information (in the example explained above, the luminance information for evening 17*c*) corresponding to a period of time determined during the exit from the tunnel section T2 to the luminance adjusting unit 12. However, it is also possible to adopt a configuration for resetting the manual setting before and after a tunnel section and, after exit from a tunnel, determining the luminance of the display screen 15 based on time information. In this case, the luminance determining unit 13 does not need to store the luminance information immediately before entry into tunnel 19 in the storing unit 16 during the entry into the tunnel.

Figure 12:
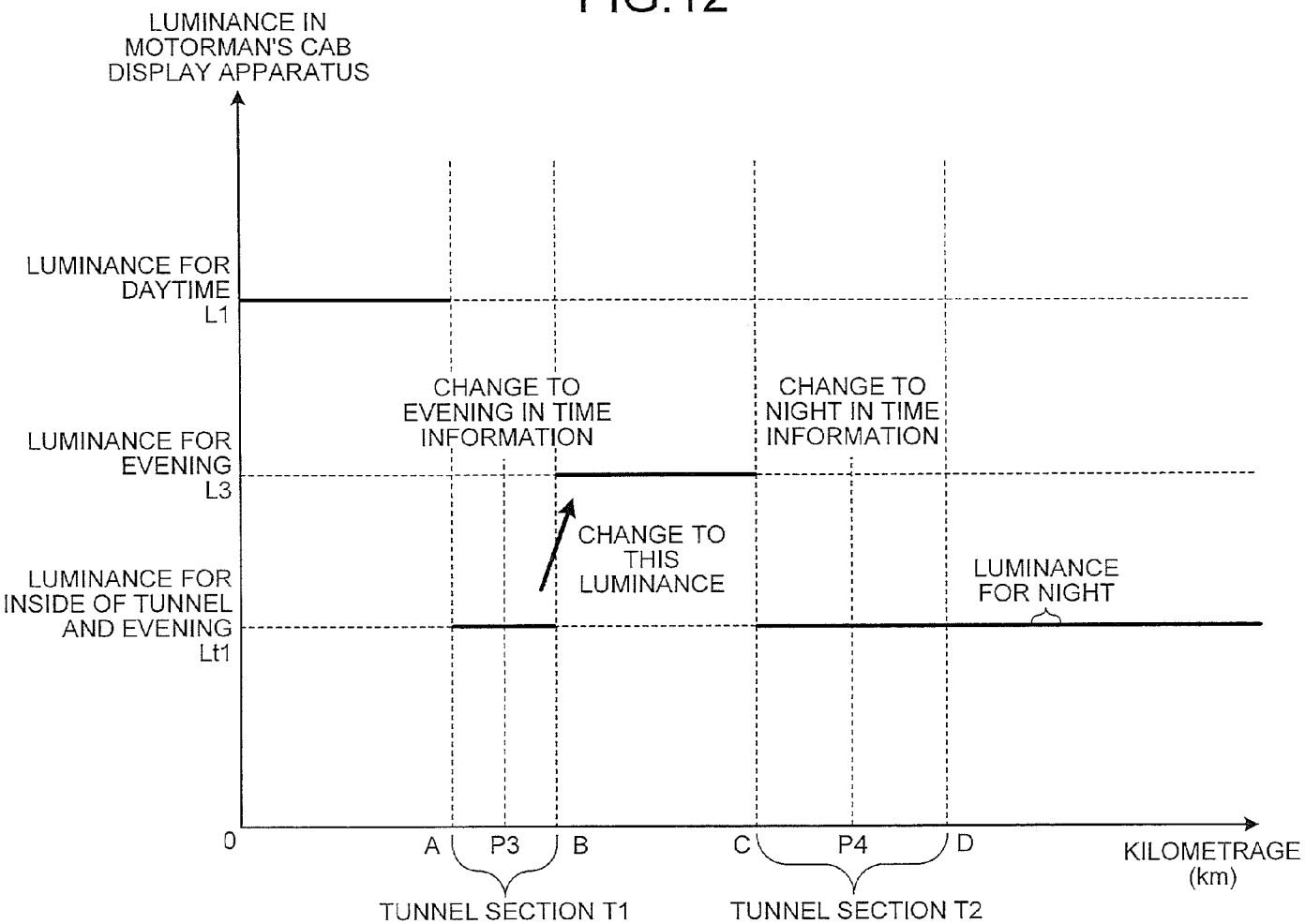
FIG. 12 is a diagram of a pattern of luminance during traveling in a period of time when the daytime changes to the evening and a period of time when the evening changes to night.

FIG. 12 is a diagram of a pattern of luminance during traveling in a period of time when the daytime changes to the evening and a period of time when the evening changes to night. The luminance is the same as that shown in FIG. 5 until the train reaches the kilometrage A at the starting end of the tunnel section T1. In the pattern shown in FIG. 12, a period of time enters the period of time in the evening from the period of time in the daytime while the train is traveling in the tunnel section T1. Specifically, the period of time changes at the point of kilometrage P3. In this case, the luminance of the display screen 15 is set to the luminance for evening L3 at the kilometrage B at the terminal end of the tunnel section T1. Specifically, in the tunnel section T1, the luminance determining unit 13 receives kilometrage information (the kilometrage K) from the location-information calculating unit 21 and receives the present time information from the clock unit 22. When the train reaches the kilometrage B at the terminal end of the tunnel section T1, the luminance determining unit 13 determines that K>B. Further, the luminance determining unit 13 compares the time information and the sunrise and sunset hour information 29, determines a period of time to which the present time belongs is the period of time in the evening, and outputs the luminance information for evening 17*c* to the luminance adjusting unit 12. Consequently, the luminance adjusting unit 12 sets the luminance of the display screen to the luminance for evening L3 from the luminance for inside of tunnel Lt1.

Further, the same applies when, for example, at the point of kilometrage P4, the period of time changes from the period of time in the evening to the period of time at night. In an example explained herein, the luminance for inside of tunnel and the luminance for night are equal (both the luminances are the luminance Lt1). Therefore, the luminance of the display screen 15 is not changed at the kilometrage D at the terminal end of the tunnel section T2. When it is bright to some degree even at night in the city, the luminance for night may be set slightly higher than the luminance for inside of tunnel.

As explained above, according to the second embodiment, by using the kilometrage information and the time information of the train information control system 1, it is possible to perform automatic luminance adjustment for the motorman's cab display apparatus 10 according to a traveling section and a period of time without adding a new device or component such as a luminance sensor.

The other components, actions, and effects of the second embodiment are the same as those in the first embodiment. For example, as in the first embodiment, it is possible to calculate a time difference between time when the first car reaches a starting end of a tunnel section and time when the last car reaches the starting end and delay timing for switching of the luminance of the display screen 15 of the motorman's cab display apparatus 10 of the last car by the time difference. Further, the same applies when the train exits the tunnel section.

The clock unit 22 may be provided in the motorman's cab display apparatus 10 instead of being provided in the information control central apparatus 20.

Third Embodiment

Figure 13:
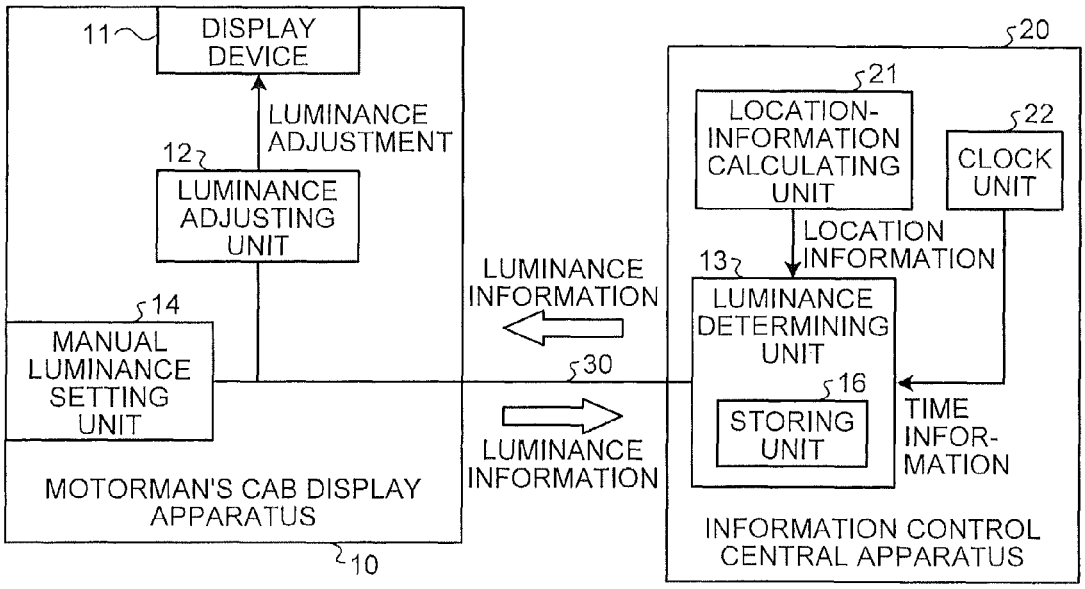
FIG. 13 is a diagram in which a schematic configuration of a motorman's cab display apparatus according to a third embodiment is mainly shown.

FIG. 13 is a diagram in which a schematic configuration of a motorman's cab display apparatus according to a third embodiment is mainly shown. In the following explanation, components same as those in the second embodiment are denoted by the same reference numerals and signs. Differences from the second embodiment are explained. In the third embodiment, the luminance determining unit 13 is present in the information control central apparatus 20. Transmission of location information from the location-information calculating unit 21 to the luminance determining unit 13 and transmission of time information from the clock unit 22 to the luminance determining unit 13 are performed in the information control central apparatus 20. As in the second embodiment, the luminance determining unit 13 outputs luminance information based on location information (e.g., kilometrage information) and time information. The luminance information is transmitted to the luminance adjusting unit 12 in the motorman's cab display apparatus 10 via the transmission path for display apparatus 30. The luminance adjusting unit 12 adjusts the luminance of the display device 11 according to the obtained luminance information.

When luminance is manually adjusted using the manual luminance setting unit 14, the manually-set luminance information is transmitted to the information control central apparatus 20 via the transmission path for display apparatus 30. In the information control central apparatus 20, the luminance determining unit 13 transmits the luminance information received from the manual luminance setting unit 14 to the luminance adjusting unit 12 via the transmission path for display apparatus 30. The luminance adjusting unit 12 adjusts the luminance of the display device 11 according to the obtained luminance information. It is also possible to adopt a configuration for directly outputting the luminance information set by the manual luminance setting unit 14 to the luminance adjusting unit 12 not through the luminance determining unit 13.

The luminance determining unit 13 can be provided on the outside of the information control central apparatus 20 and the motorman's cab display apparatus 10. For example, the luminance determining unit 13 can be interposed as an independent apparatus between the information control central apparatus 20 and the motorman's cab display apparatus 10.

As explained above, according to the third embodiment, by using the kilometrage information and the time information of the train information control system 1, it is possible to perform automatic luminance adjustment for the motorman's cab display apparatus 10 according to a traveling section and a period of time without adding a new device or component such as a luminance sensor. The other components, actions, and effects of the third embodiment are the same as those in the first embodiment or second embodiment.

INDUSTRIAL APPLICABILITY

As explained above, the present invention is useful as a motorman's cab display system including a motorman's cab display apparatus set in a motorman's cab in a motorman's car or a conductor's compartment of a train.

REFERENCE SIGNS LIST

10 motorman's cab display apparatus
11 display device
12 luminance adjusting unit
13 luminance determining unit
14 manual luminance setting unit
15 display screen
16 storing unit
17*a* luminance information for daytime
17*b* luminance information for inside of tunnel
17*c* luminance information for evening
17*d* luminance information for night
18 kilometrage information of tunnel section
19 luminance information immediately before entry into tunnel
20 information control central apparatus
21 location-information calculating unit
22 clock unit
29 sunrise and sunset hour information
30 transmission path for display apparatus
31 inter-car transmission path
32 intra-car transmission path
40 information control terminal apparatus
50 apparatuses

The invention claimed is:

1. A motorman's cab display system comprising:

information control terminal apparatuses respectively mounted on cars of a train, connected to one another by an inter-car transmission path, and configured to collect state information of apparatuses mounted on the cars and output control information to the apparatuses;

information control central apparatuses respectively mounted on a first car and a last car of the train, connected to the information control terminal apparatuses by the inter-car transmission path, and configured to manage train information including the state information received from the information control terminal apparatuses and the control information transmitted to the information control terminal apparatuses;

motorman's cab display apparatuses respectively mounted on the first car and the last car, connected to the information control central apparatuses by transmission paths for display apparatus, and configured to display the train information transmitted from the information control central apparatuses on a display screen of a display device; and a luminance determining unit configured to output luminance information for setting luminance of the display screen, wherein the information control central apparatus includes a location-information calculating unit configured to calculate a traveling location of the train and output location information of the train, the motorman's cab display apparatus includes a luminance adjusting unit configured to adjust the luminance of the display screen according to the luminance information output from the luminance determining unit, and the luminance determining unit compares location information at both ends of a tunnel section on a track of the train and the location information of the train output from the location-information calculating unit, outputs, when determining that the train is traveling in a tunnel, luminance information for inside of tunnel set in advance, and outputs, when determining that the train is traveling outside the tunnel, luminance information for outside of tunnel set in advance, wherein the luminance determining unit is provided in the motorman's cab display apparatus, and the location-information calculating unit transmits the location information of the train to the luminance determining unit via the transmission path for display apparatus, wherein when the train enters the tunnel section, the luminance determining unit outputs the luminance information for inside of tunnel to the luminance adjusting unit, wherein the motorman's cab display apparatus includes a manual luminance setting unit configured to output manually-input and set luminance information to the luminance determining unit, and the luminance determining unit outputs the luminance information input from the manual luminance setting unit to the luminance adjusting unit, wherein the luminance determining unit stores luminance information of the display screen immediately before entry into the tunnel section and outputs, when the train exits the tunnel section, luminance information of the display screen immediately before entry into the tunnel section to the luminance adjusting unit, wherein the information control central apparatus transmits speed information of the train to the luminance determining unit, the luminance determining unit of the motorman's cab display apparatus mounted on the first car compares the location information from the location-information calculating unit and the location information at both the ends of the tunnel section and outputs, when determining that the first car reaches a starting end of the tunnel section, the luminance information for inside of tunnel to the luminance adjusting unit of the motorman's cab display apparatus, and the luminance determining unit of the motorman's cab display apparatus mounted on the last car compares the location information from the location-information calculating unit and the location information at both the ends of the tunnel section, calculates, after determining that the first car reaches the starting end of the tunnel section, a predicted time difference until the last car reaches a location of the first car at the time of the determination by dividing formation length of the train by speed of the train at the time of the determination obtained from the speed information, and outputs, when time elapses by the predicted time difference, the luminance information for inside of tunnel to the luminance adjusting unit of the motorman's cab display apparatus.

2. The motorman's cab display system according to claim 1, wherein the information control central apparatus transmits speed information of the train to the luminance determining unit, the luminance determining unit of the motorman's cab display apparatus mounted on the first car outputs luminance information of the display screen immediately before the entry into the tunnel section to the luminance adjusting unit of the motorman's cab display apparatus when determining based on comparison of the location information from the location-information calculating unit and the location information at both the ends of the tunnel section that the first car reaches a terminal end of the tunnel section after the train enters the tunnel section, the luminance determining unit of the motorman's cab display apparatus mounted on the last car calculates, after determining based on comparison of the location information from the location-information calculating unit and the location information at both the ends of the tunnel section that the first car reaches the terminal end of the tunnel section after the train enters the tunnel section, a predicted time difference until the last car reaches a location of the first car at the time of the determination by dividing formation length of the train by speed of the train at the time of the determination obtained from the speed information, and outputs, when time elapses by the predicted time difference, the luminance information of the display screen immediately before the entry into the tunnel section to the luminance adjusting unit of the motorman's cab display apparatus.

3. The motorman's cab display system according to claim 1, wherein, when luminance information manually input and set from the manual luminance setting unit is input to the luminance determining unit in the tunnel section, the luminance determining unit outputs the luminance information input and set from the manual luminance setting unit to the luminance adjusting unit, stores the luminance information, and outputs, when the train enters a next tunnel section after exiting the tunnel section, the luminance information used and stored in the tunnel section to the luminance adjusting unit.

4. The motorman's cab display system according to claim 1, wherein the information control central apparatus includes a clock unit configured to output time information, and the luminance determining unit compares the location information at both the ends of the tunnel section on the track of the train and the location information of the train, outputs, when determining that the train is traveling in a tunnel, luminance information for inside of tunnel set in advance, determines, when determining that the train is traveling outside the tunnel, based on the time information output from the clock unit which period of time among a period of time in daytime, a period of time in morning or evening, and a period of time at night defined in advance present time belongs, and outputs, according to a determination result of the period of time, luminance information for daytime, luminance information for morning or evening, or luminance information for night set in advance.

5. The motorman's cab display system according to claim 1, wherein the luminance determining unit includes sunrise and sunset hour information for giving sunrise and sunset hours according to month and day, and the luminance determining unit determines that present time obtained from the time information belongs to the period of time in the morning or the evening when the present time belongs to a predetermined time before and after sunrise hour or a predetermined time before and after sunset hour obtained from the sunrise and sunset hour information, determines that the present time belongs to the period of time at night when the present time belongs to a period of time from time after the predetermined time elapses from the sunset hour until time the predetermined time before the sunrise hour, and determines that the present time belongs to the period of time in the daytime when the present time belongs to a period of time other than the period of time in the morning or the evening and the period of time at night.

6. The motorman's cab display system according to claim 1, wherein the luminance determining unit includes sunrise and sunset hour information for giving sunrise and sunset hours according to month and day and a traveling location of the train, and the luminance determining unit specifies, based on the location information, sunrise and sunset hours corresponding to the traveling location of the train, determines that present time obtained from the time information belongs to the period of time in the morning or the evening when the present time belongs to a predetermined time before and after sunrise hour or a predetermined time before and after sunset hour corresponding to the traveling location obtained from the sunrise and sunset hour information, determines that the present time belongs to the period of time at night when the present time belongs to a period of time from time after the predetermined time elapses from the sunset hour until time the predetermined time before the sunrise hour, and determines that the present time belongs to the period of time in the daytime when the present time belongs to a period of time other than the period of time in the morning or the evening and the period of time at night.

7. The motorman's cab display system according to claim 1, wherein the motorman's cab display apparatus includes a manual luminance setting unit configured to output manually-input and set luminance information to the luminance determining unit, and the luminance determining unit stores luminance information of the display screen immediately before the entry into the tunnel section and outputs, when luminance of the display screen immediately before the entry into the tunnel section is manually set via the manual luminance setting section, the luminance information of the display screen immediately before the entry into the tunnel section to the luminance adjusting unit when the train exits the tunnel section.

8. A motorman's cab display system comprising:

information control terminal apparatuses respectively mounted on cars of a train, connected to one another by an inter-car transmission path, and configured to collect state information of apparatuses mounted on the cars and output control information to the apparatuses;

information control central apparatuses respectively mounted on a first car and a last car of the train, connected to the information control terminal apparatuses by the inter-car transmission path, and configured to manage train information including the state information received from the information control terminal apparatuses and the control information transmitted to the information control terminal apparatuses;

motorman's cab display apparatuses respectively mounted on the first car and the last car, connected to the information control central apparatuses by transmission paths for display apparatus, and configured to display the train information transmitted from the information control central apparatuses on a display screen of a display device; and a luminance determining unit configured to output luminance information for setting luminance of the display screen, wherein the information control central apparatus includes a location-information calculating unit configured to calculate a traveling location of the train and output location information of the train, the motorman's cab display apparatus includes a luminance adjusting unit configured to adjust the luminance of the display screen according to the luminance information output from the luminance determining unit, and the luminance determining unit compares location information at both ends of a tunnel section on a track of the train and the location information of the train output from the location-information calculating unit, outputs, when determining that the train is traveling in a tunnel, luminance information for inside of tunnel set in advance, and outputs, when determining that the train is traveling outside the tunnel, luminance information for outside of tunnel set in advance, wherein the luminance determining unit is provided in the information control central apparatus, wherein when the train enters the tunnel section, the luminance determining unit outputs the luminance information for inside of tunnel to the luminance adjusting unit, wherein the motorman's cab display apparatus includes a manual luminance setting unit configured to output manually-input and set luminance information to the luminance determining unit, and the luminance determining unit outputs the luminance information input from the manual luminance setting unit to the luminance adjusting unit, wherein the luminance determining unit stores luminance information of the display screen immediately before entry into the tunnel section and outputs, when the train exits the tunnel section, luminance information of the display screen immediately before entry into the tunnel section to the luminance adjusting unit, wherein the information control central apparatus transmits speed information of the train to the luminance determining unit, the luminance determining unit of the motorman's cab display apparatus mounted on the first car compares the location information from the location-information calculating unit and the location information at both the ends of the tunnel section and outputs, when determining that the first car reaches a starting end of the tunnel section, the luminance information for inside of tunnel to the luminance adjusting unit of the motorman's cab display apparatus, and the luminance determining unit of the motorman's cab display apparatus mounted on the last car compares the location information from the location-information calculating unit and the location information at both the ends of the tunnel section, calculates, after determining that the first car reaches the starting end of the tunnel section, a predicted time difference until the last car reaches a location of the first car at the time of the determination by dividing formation length of the train by speed of the train at the time of the determination obtained from the speed information, and outputs, when time elapses by the predicted time difference, the luminance information for inside of tunnel to the luminance adjusting unit of the motorman's cab display apparatus.

9. The motorman's cab display system according to claim 8, wherein the information control central apparatus transmits speed information of the train to the luminance determining unit, the luminance determining unit of the motorman's cab display apparatus mounted on the first car outputs luminance information of the display screen immediately before the entry into the tunnel section to the luminance adjusting unit of the motorman's cab display apparatus when determining based on comparison of the location information from the location-information calculating unit and the location information at both the ends of the tunnel section that the first car reaches a terminal end of the tunnel section after the train enters the tunnel section, the luminance determining unit of the motorman's cab display apparatus mounted on the last car calculates, after determining based on comparison of the location information from the location-information calculating unit and the location information at both the ends of the tunnel section that the first car reaches the terminal end of the tunnel section after the train enters the tunnel section, a predicted time difference until the last car reaches a location of the first car at the time of the determination by dividing formation length of the train by speed of the train at the time of the determination obtained from the speed information, and outputs, when time elapses by the predicted time difference, the luminance information of the display screen immediately before the entry into the tunnel section to the luminance adjusting unit of the motorman's cab display apparatus.

10. The motorman's cab display system according to claim 8, wherein, when luminance information manually input and set from the manual luminance setting unit is input to the luminance determining unit in the tunnel section, the luminance determining unit outputs the luminance information input and set from the manual luminance setting unit to the luminance adjusting unit, stores the luminance information, and outputs, when the train enters a next tunnel section after exiting the tunnel section, the luminance information used and stored in the tunnel section to the luminance adjusting unit.

11. The motorman's cab display system according to claim 8, wherein the information control central apparatus includes a clock unit configured to output time information, and the luminance determining unit compares the location information at both the ends of the tunnel section on the track of the train and the location information of the train, outputs, when determining that the train is traveling in a tunnel, luminance information for inside of tunnel set in advance, determines, when determining that the train is traveling outside the tunnel, based on the time information output from the clock unit which period of time among a period of time in daytime, a period of time in morning or evening, and a period of time at night defined in advance present time belongs, and outputs, according to a determination result of the period of time, luminance information for daytime, luminance information for morning or evening, or luminance information for night set in advance.

12. The motorman's cab display system according to claim 8, wherein the luminance determining unit includes sunrise and sunset hour information for giving sunrise and sunset hours according to month and day, and the luminance determining unit determines that present time obtained from the time information belongs to the period of time in the morning or the evening when the present time belongs to a predetermined time before and after sunrise hour or a predetermined time before and after sunset hour obtained from the sunrise and sunset hour information, determines that the present time belongs to the period of time at night when the present time belongs to a period of time from time after the predetermined time elapses from the sunset hour until time the predetermined time before the sunrise hour, and determines that the present time belongs to the period of time in the daytime when the present time belongs to a period of time other than the period of time in the morning or the evening and the period of time at night.

13. The motorman's cab display system according to claim 8, wherein the luminance determining unit includes sunrise and sunset hour information for giving sunrise and sunset hours according to month and day and a traveling location of the train, and the luminance determining unit specifies, based on the location information, sunrise and sunset hours corresponding to the traveling location of the train, determines that present time obtained from the time information belongs to the period of time in the morning or the evening when the present time belongs to a predetermined time before and after sunrise hour or a predetermined time before and after sunset hour corresponding to the traveling location obtained from the sunrise and sunset hour information, determines that the present time belongs to the period of time at night when the present time belongs to a period of time from time after the predetermined time elapses from the sunset hour until time the predetermined time before the sunrise hour, and determines that the present time belongs to the period of time in the daytime when the present time belongs to a period of time other than the period of time in the morning or the evening and the period of time at night.

14. The motorman's cab display system according to claim 8, wherein the motorman's cab display apparatus includes a manual luminance setting unit configured to output manually-input and set luminance information to the luminance determining unit, and the luminance determining unit stores luminance information of the display screen immediately before the entry into the tunnel section and outputs, when luminance of the display screen immediately before the entry into the tunnel section is manually set via the manual luminance setting section, the luminance information of the display screen immediately before the entry into the tunnel section to the luminance adjusting unit when the train exits the tunnel section.

15. A display control method for motorman's cab display apparatuses respectively mounted on a first car and a last car of a train, connected to information control central apparatuses that collect and manage train information and transmission paths for display apparatus, and configured to display the train information transmitted from the information control central apparatuses on a display screen of a display device, the display control method comprising:

calculating a traveling location of the train and outputting location information of the train to a luminance determining unit;

comparing location information at both ends of a tunnel section on a track of the train with the location information of the train output by a location-information calculating unit, outputting, when determining that the train is traveling in a tunnel, luminance information for inside of tunnel set in advance, and outputting, when determining that the train is traveling outside the tunnel, luminance information for outside of tunnel set in advance;

adjusting the luminance of the display screen according to the luminance information output from the luminance determining unit;

transmitting the location information of the train to the luminance determining unit via the transmission paths for display apparatus;

outputting manually-input and set luminance information to the luminance determining unit;

outputting the luminance information input from a manual luminance setting unit to a luminance adjusting unit;

transmitting speed information of the train to the luminance determining unit;

comparing the location information from the location-information calculating unit and the location information at both the ends of the tunnel section and outputting the luminance information for inside of tunnel to the luminance adjusting unit of the motorman's cab display apparatus;

calculating, after determining that the first car reaches the starting end of the tunnel section, a predicted time difference until the last car reaches a location of the first car at a time of determination by dividing formation length of the train by speed of the train at the time of the determination obtained from the speed information; and outputting, when time elapses by the predicted time difference, the luminance information for inside of tunnel to the luminance adjusting unit of the motorman's cab display apparatus.

* * * * *